US006820764B2

(12) United States Patent
Miani et al.

(10) Patent No.: US 6,820,764 B2
(45) Date of Patent: Nov. 23, 2004

(54) CLOSABLE OPENING DEVICE FOR SEALED PACKAGES OF POURABLE FOOD PRODUCTS

(75) Inventors: Claudia Miani, Bologna (IT); Danilo Veroni, Rubiera (IT); Cristiano Casale, Spilamberto (IT)

(73) Assignee: Tetra Laval Holdings & 'Finance SA, Pully (CH)

( * ) Notice: Subject to any disclaimer, the term of this patent is extended or adjusted under 35 U.S.C. 154(b) by 191 days.

(21) Appl. No.: 10/156,078

(22) Filed: May 29, 2002

(65) Prior Publication Data

US 2002/0179605 A1 Dec. 5, 2002

(30) Foreign Application Priority Data

May 29, 2001 (EP) ..... 01830344

(51) Int. Cl.[7] ..... B67D 5/00
(52) U.S. Cl. ..... 222/83; 222/91
(58) Field of Search ..... 222/81, 82, 83, 222/90, 91

(56) References Cited

U.S. PATENT DOCUMENTS

| | | | | |
|---|---|---|---|---|
| 3,415,405 | A | | 12/1968 | Rausing et al. |
| 3,883,034 | A | | 5/1975 | Rausing |
| 3,900,155 | A | | 8/1975 | Råusing et al. |
| 3,977,591 | A | | 8/1976 | M>rtensson et al. |
| 3,999,678 | A | | 12/1976 | Ignell et al. |
| 4,078,688 | A | | 3/1978 | Nilsson et al. |
| 4,101,051 | A | | 7/1978 | Reil |
| 4,109,814 | A | | 8/1978 | Rausing |
| 4,113,101 | A | | 9/1978 | Pupp et al. |
| 4,140,235 | A | | 2/1979 | Rausing et al. |
| 4,149,651 | A | | 4/1979 | Ignell |
| 4,220,249 | A | | 9/1980 | Nilsson |
| 4,243,152 | A | | 1/1981 | Ignell |
| 4,387,820 | A | | 6/1983 | Ignell |
| 4,391,385 | A | | 7/1983 | Rausing |
| 4,399,924 | A | | 8/1983 | Nilsson |
| 4,410,128 | A | | 10/1983 | Rausing |
| 4,483,464 | A | * | 11/1984 | Nomura ..... 222/83 |
| 4,655,387 | A | | 4/1987 | Magnusson |
| 4,730,769 | A | | 3/1988 | Stark |
| 4,884,705 | A | * | 12/1989 | Debetencourt ..... 215/250 |
| 5,020,690 | A | * | 6/1991 | Kishikawa et al. ..... 222/83 |
| 5,199,618 | A | | 4/1993 | Reil et al. |
| 5,248,054 | A | | 9/1993 | Berggren et al. |
| 5,255,813 | A | | 10/1993 | Berggren et al. |
| 5,366,114 | A | * | 11/1994 | Bernstein et al. ..... 222/83 |
| 5,372,300 | A | | 12/1994 | Nedstedt |
| 5,482,176 | A | * | 1/1996 | Maietta et al. ..... 220/277 |
| 5,498,149 | A | | 3/1996 | Bengtsson |
| 5,498,225 | A | | 3/1996 | Nedstedt |
| D377,145 | S | | 1/1997 | Huser |
| 5,947,318 | A | | 9/1999 | Palm |
| 6,279,779 | B1 | * | 8/2001 | Laciacera et al. ..... 222/83 |
| 6,398,075 | B1 | * | 6/2002 | Laciacera et al. ..... 222/91 |

FOREIGN PATENT DOCUMENTS

| | | | |
|---|---|---|---|
| EP | 0 328 652 | A1 | 8/1989 |
| EP | 1 088 765 | A1 | 4/2001 |
| WO | 95/05996 | A1 | 3/1995 |

* cited by examiner

*Primary Examiner*—Kevin Shaver
*Assistant Examiner*—Stephanie L. Willatt
(74) *Attorney, Agent, or Firm*—Burns, Doane, Swecker & Mathis, L.L.P.

(57) ABSTRACT

There is described a closable opening device for a sealed package containing a pourable food product. The opening device has a tubular frame defining a through hole and fitted about a pierceable portion of the package; a removeable threaded frame which screws onto the frame to close the hole; and a tubular cutting member movably engaging the hole, rotatably connected to the frame at least when disengaging the cap from the frame when unsealing the package and projecting axially from the frame and inwards of the package to detach the pierceable portion partly from the rest of the package and the cutting member has, along a lateral wall, a number of through openings to allow air into the package when pouring the product.

12 Claims, 3 Drawing Sheets

CLOSABLE OPENING DEVICE FOR SEALED PACKAGES OF POURABLE FOOD PRODUCTS

The present invention relates to a closable opening device for sealed packages of pourable food products.

As is known, many pourable food products, such as fruit juice, UHT (ultra-high-temperature processed) milk, wine, tomato sauce, etc., are sold in packages made of sterilized packaging material.

A typical example of such a package is the parallelepiped-Shaped package for liquid or pourable food products known as Tetra Brik Aseptic (registered trademark), which is formed by folding and sealing laminated strip packaging material. The packaging material has a multilayer structure comprising a layer of fibrous material, e.g. paper, covered on both sides with layers of heat-seal plastic material, e.g. polyethylene, and, in the case of aseptic packages for long-storage products, such as UHT milk, also comprises a layer of oxygen-barrier material defined, for example, by an aluminium film, which is superimposed on a layer of heat-seal plastic material and is in turn covered with another layer of heat-seal plastic material eventually defining the inner face of the package contacting the food product.

Such packages are normally made on fully automatic packaging machines, on which a continuous tube is formed from the web-fed packaging material; the web of packaging material is sterilized on the packaging machine itself, e.g. by applying a chemical sterilizing agent, such as a hydrogen peroxide solution, which, after sterilization, is removed, e.g. vaporized by heating, from the surfaces of the packaging material; and the web of packaging material so sterilized is maintained in a closed sterile environment, and is folded and sealed longitudinally to form a vertical tube.

The tube is filled with the sterilized or sterile-processed food product, and is sealed and cut at equally spaced cross sections to form pillow packs, which are then folded mechanically to form the finished, e.g. substantially parallelepiped-shaped, packages.

Alternatively, the packaging material may be cut into blanks, which are formed into packages on forming spindles, and the resulting packages are filled with the food product and sealed. One example of such a package is the so-called "gable-top" package commonly known by the trade name Tetra Rex (registered trademark).

To open such packages, various solutions have been proposed, one of which, described in U.S. Pat. Nos. 4,655,387 and No. 4,410,128, consists in forming, at the corner of a flap on the package, a preferential tear line defined by a succession of perforations extending through the outer layers of the packaging material down to the layer of barrier material; and the package is opened by lifting the flap and cutting or tearing along the perforations. Packages of this type, however, cannot, obviously, be closed once opened, and must therefore be handled with care to prevent spillage of the remaining food product inside the package.

By way of a solution to the problem, packages of the type described above have been provided with closable opening devices, which substantially comprise a frame defining an opening and fitted over a hole or a pierceable or removable portion in a wall of the package; and a cap hinged to the frame. The cap is normally molded integrally with the frame, and is initially sealed to the frame, along a peripheral edge surrounding the opening, by a thin breakable annular connecting portion. Once unsealed, the cap is movable between a closed position cooperating in fluidtight manner with the frame, and an open position. Alternatively, threaded caps are also used, which are separate from and initially screwed to the frame.

One problem posed by such opening devices is ensuring practically no effort is required to detach the cap from the frame when unsealing the package. For which reason, the opening devices are made of low-tear-strength plastic material, normally polyethylene.

Since polyethylene, however, fails to act as an effective oxygen barrier, the side of the packaging material eventually defining the inside of the package must be fitted over the hole with an additional patch member defined by a small sheet of heat-seal plastic material; and the opposite side of the packaging material must be fitted with an oxygen-barrier member, e.g. a removable tongue, heat sealed to the patch member and comprising a layer of aluminium.

Providing the packages with barrier and patch members calls for additional processing of the packaging material, before this is sterilized and folded and sealed into a vertical tube, thus increasing the production time and cost of the packages.

Moreover, after unsealing the cap, the user must also remove the barrier member to open the package.

Closable opening devices have therefore been devised to enable the package to be opened in one operation, while at the same time ensuring an effective oxygen barrier.

According to the solution described in International Patent Application WO 95/05996 or in European patent Application EP-A-1088765, such opening devices substantially comprise a frame having a cylindrical collar defining a pour opening and fitted about a pierceable portion of the package; a removable cap which screws onto the outside of the frame collar to close the opening; and a substantially tubular cutting member screwed inside the frame collar and having an end edge with cutting means, e.g. a number of triangular end teeth or a single saw-tooth cutter, which cooperate with and partly detach the pierceable portion of the package from the relative wall, i.e. with the exception of a small-angle portion.

The cutting member is activated by the cap by means of one-way ratchet-type transmission means—operated when disengaging the cap from the collar—and is movable in a spiral with respect to the frame from a raised rest position, in which the cutting means face the pierceable portion, into successive lowered cutting positions in which the cutting means interact with the pierceable portion.

Though perfectly functional and enabling the package to be opened in one operation, opening devices of the above type—comprising tubular cutting members with a number of teeth or a single cutter—still leave room for improvement, particularly as regards pouring of the product, which is often irregular and characterized by so-called "gulping". This is caused when, tilting the package to pour out the product, the liquid product inside, whose free surface is constantly horizontal, completely wets the end edge of the cutting member inside the package, and partly wets the outermost end edge of the frame collar, thus isolating the inside of the package from the outside and creating a vacuum inside the package, which tends to slow down and even cut off outflow of the product. On rectifying the above condition, e.g. by adjusting the tilt of the package to allow air in, the product flows out in gulps, which are produced for a range of package tilt angles directly proportional to the overall axial dimension of the frame and the cutting member, which, once the package is opened, forms an extension of the frame.

It is an object of the present invention to provide a closable opening device for sealed packages of pourable food products, designed to eliminate the aforementioned drawbacks typically associated with known opening devices.

According to the present invention, there is provided a closable opening device for a sealed package containing a pourable food product, said device comprising:

a frame defining a through hole and fitted about a pierceable portion of said package;

a removable threaded cap which screws onto said frame to close said hole; and a tubular cutting member movably engaging said hole rotatably, connected to said cap at least when disengaging the cap from said frame when unsealing said package, and projecting axially from said frame and inwards of said package to detach said pierceable portion partly from the rest of said package;

characterized in that said cutting member comprises, along a lateral wall, at least one through opening to allow air into the package when pouring the product.

A preferred, non-limiting embodiment of the present invention will be described by way of example with reference to the accompanying drawings, in which.

Figure 1:
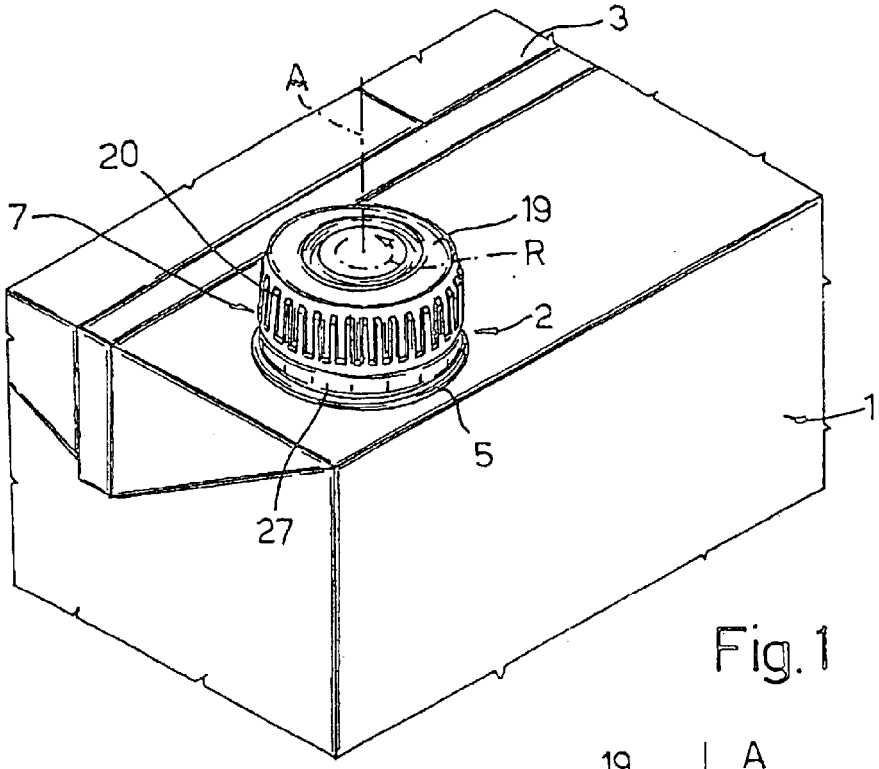
FIG. 1 shows a view in perspective of a top portion of a sealed package for pourable food products, having a closable opening device in accordance with the present invention.
Figure 7:
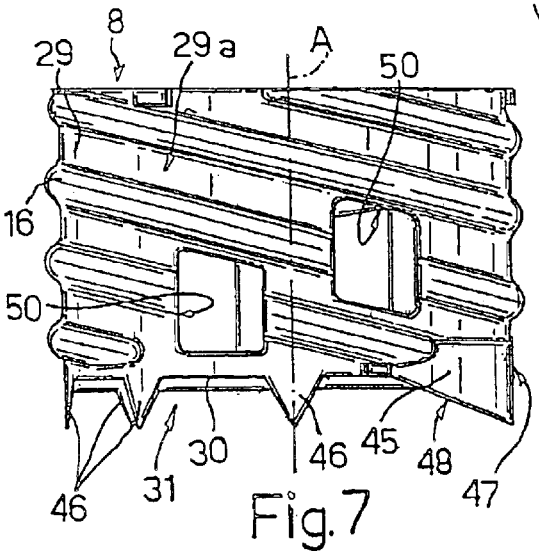
FIG. 7 shows a larger-scale side view of a cutting member of the FIG. 1 opening device.
Figure 2:
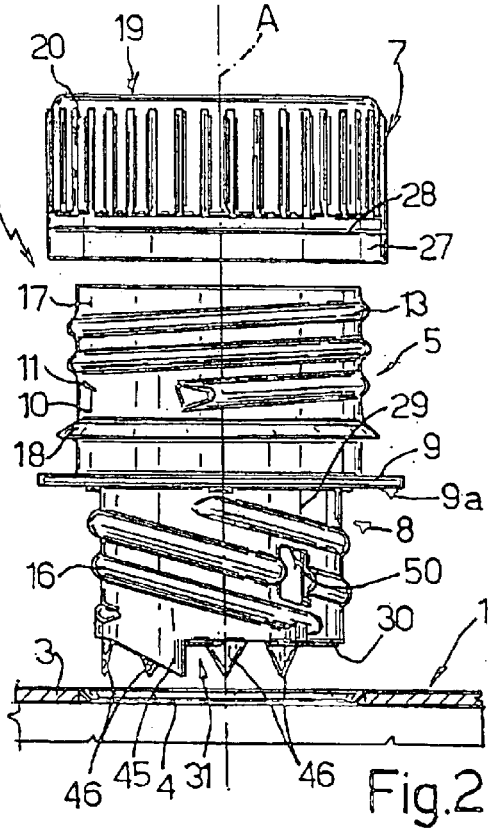
FIG. 2 shows a larger-scale, exploded side view of the FIG. 1 opening device before being fitted to the respective package.

Number 1 in FIG. 1 indicates as a whole an aseptic sealed package for pourable food products, e.g. a parallelepiped-shaped package known as Tetra Brik Aseptic (registered trademark), which is made from sheet packaging material as described in detail previously, and which comprises a closable opening device 2 made of plastic material and fitted to package 1 in conventional manner, e.g. by means of adhesive substances, or using microflame or laser sealing techniques.

The packaging material has a multilayer structure, and comprises, in a top wall 3 of package 1, a circular pierceable portion 4 of axis A, which, in use, is covered externally by opening device 2 and is detached at least partly from wall 3 to pour the product out of package 1.

In the case of nonaseptic packages for pasteurized products (e.g. yoghurt, cream and other cold-range products), the packaging material comprises a layer of fibrous material, normally paper, covered on the outer and inner sides with respective layers of thermoplastic material, e.g. polyethylene; and pierceable portion 4 is defined by a preferential tear line formed in the layer of fibrous material and defined by a succession of perforations.

In the case of aseptic packages for long-storage products such as UHT milk, the packaging material also comprises, on the side eventually contacting the food product in package 1, a layer of barrier material, e.g.aluminium, in turn covered with one or more layers of thermoplastic material; and pierceable portion 4 is defined by respective portions of the layers of thermoplastic and barrier material covering a hole, of axis A, formed in the layer of fibrous material.

With reference to FIGS. 2–5, opening device 2 comprises a frame 5 defining a through hole 6 of axis A, through which the food product is poured, and fitted about pierceable portion 4 on wall 3 of package 1; a cap 7 formed separately from frame 5 and fitted coaxially onto frame 5 to close hole 6; and a tubular cutting member 8 of axis A, which engages hole 6 in axially and angularly movable manner and is activated by cap 7 to interact with pierceable portion 4 of wall 3 to open package 1.

More specifically, frame 5 comprises a circular annular base flange 9, an end surface 9*a* of which is fitted about pierceable portion 4 on wall 3 of package 1, and from the radially inner edge of which projects axially a cylindrical collar 10 of axis A defining hole 6.

On respective opposite lateral surfaces 11, 12, collar 10 comprises an outer thread 13 and an inner thread 14, which slope in opposite directions with respect to axis A, and, in use, respectively engage a thread 15 of cap 7 and a thread 16 of cutting member 8. More specifically, thread 13 extends along most of surface 11, except for a bottom cylindrical band of surface 11 adjacent to flange 9; and, similarly, thread 14 extends along most of surface 12, except for a top cylindrical band of surface 12 adjacent to an end edge 17 of collar 10 at the opposite end to flange 9.

Thread 14 is a multiple—in the example shown, a triple—thread of a pitch greater than that of thread 13.

Collar 10 also comprises, on surface 11, an annular rib 18 interposed axially between one end of thread 13 and flange 9, and located a constant axial distance from flange 9.

With reference to FIGS. 1 to 6, cap 7 comprises a hollow cylindrical body defined by a circular end wall 19 for closing hole 6, and by a cylindrical lateral wall 20 projecting from a peripheral edge of end wall 19, and which comprises thread 15 inside and screws onto collar '10 of frame 5.

End wall 19 comprises a projecting annular rib 25 adjacent to lateral wall 20 and defining, with lateral wall 20, a seat 26 for receiving end edge 17 of collar 10.

Cap 7 is molded integrally, in the usual way, with a respective tamperproof ring 27 connected coaxially to an end edge 28 of cap 7, at the opposite end to end wall 19, by a number of breakable radial connecting points.

Cap 7 is fitted initially to frame 5 in a sealed position, wherein the cap is screwed completely onto collar 10, with end edge 28 of the cap and tamperproof ring 27 still connected to each other and resting on opposite sides of rib 18 of collar 10. More specifically, in the sealed position, tamperproof ring 27 is clicked between flange 9 and rib 18, and seat 26 of cap 7 is engaged by end edge 17 of collar 10.

Once unsealed, cap 7 is movable between an open position, in which it is unscrewed off collar 10 and detached from frame 5, and a closed position closing hole 6.

With reference to FIGS. 2 to 7, cutting member 8, having thread 16 on an outer surface 29*a* of a cylindrical lateral wall 29, is connected inside collar 10 of frame 5 by thread 16 engaging thread 14, and has an end edge 30 having, on the face, cutting means 31 which cooperate with pierceable portion 4 to open package 1.

Figure 5:
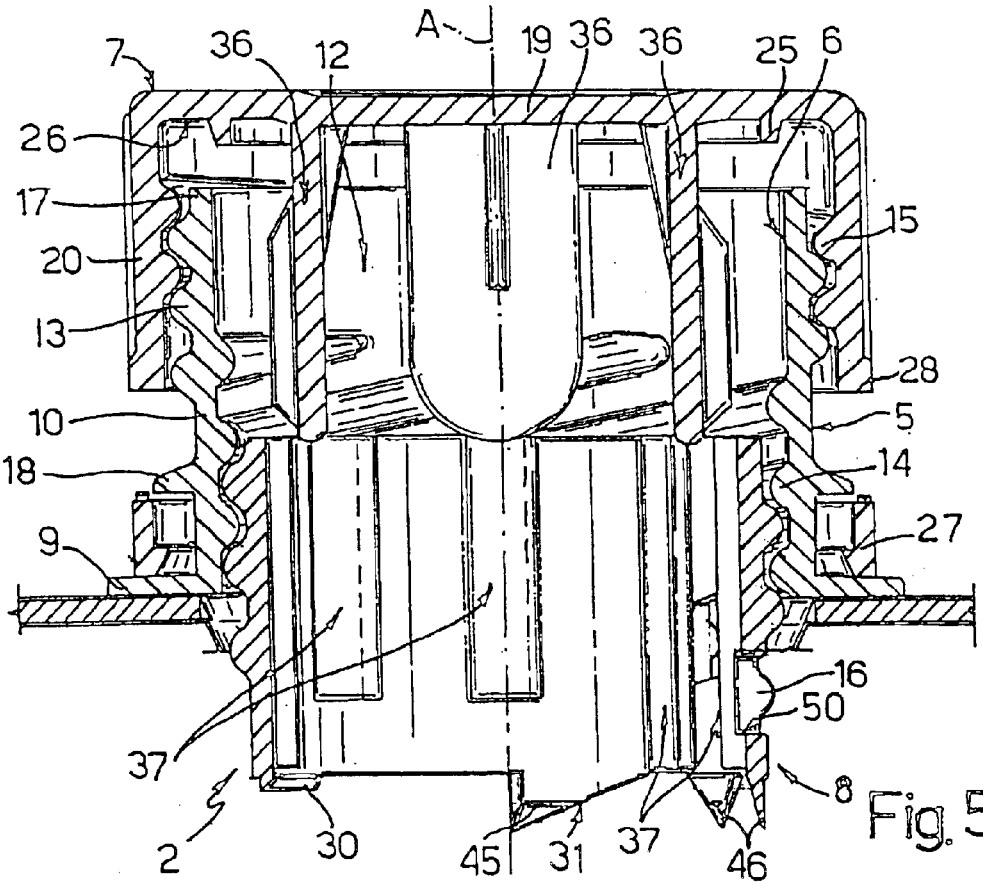
FIG. 5 shows a larger-scale axial section of the FIG. 1 opening device when opening the package.
Figure 6:
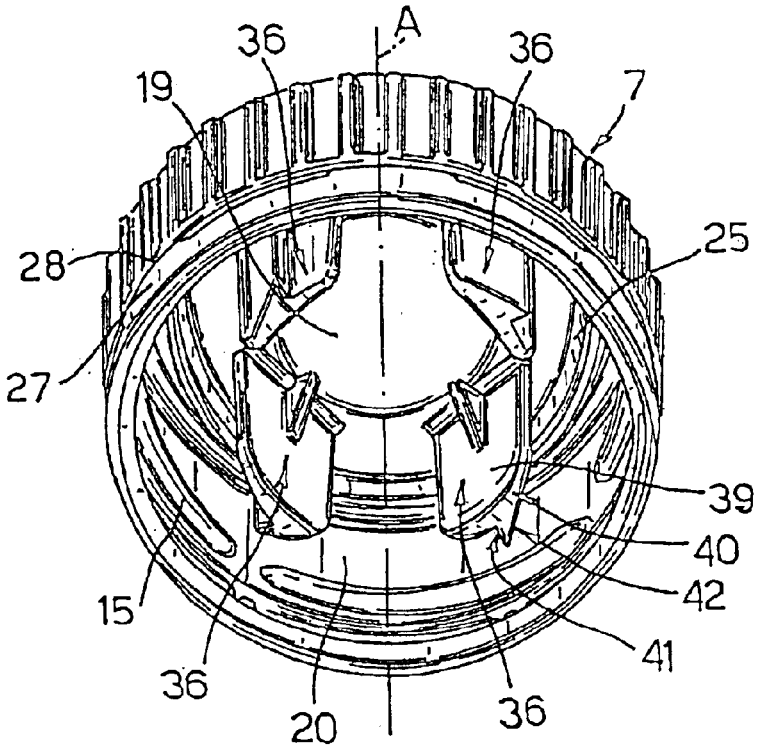
FIG. 6 shows a larger-scale underside view in perspective of a cap of the FIG. 1 opening device.
Figure 4:
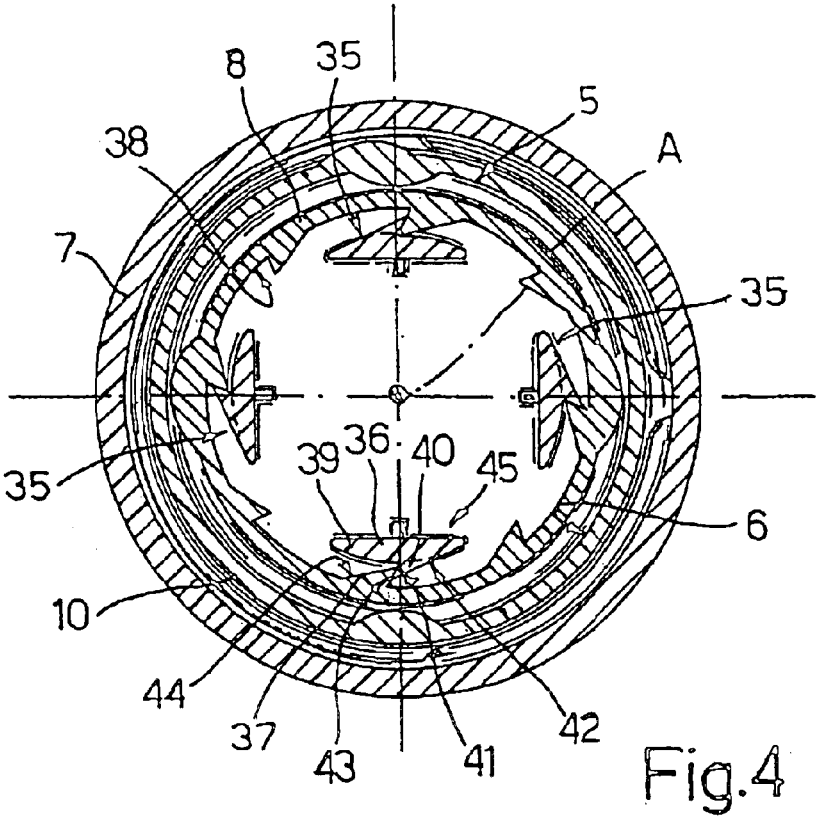
FIG. 4 shows a section along line IV—IV in FIG. 3.

When unsealing package 1, threads 14 and 16 define a spiral path, of axis A, along which cutting member 8 is fed through pierceable portion 4 from a raised rest position (FIG. 3) to a lowered opening position (FIG. 5). More specifically, in the raised rest position, cutting member 8 is housed entirely inside collar 10, with cutting means 31 facing pierceable portion 4 of package 1; and, in the lowered opening position, cutting member 8 projects axially with respect to collar 10, has penetrated a predetermined distance inside package 1, and has completed the cutting of pierceable portion 4, leaving the pierceable portion attached to wall 3 by a small-angle portion.

Displacement of cutting member 8 from the raised to the lowered position is controlled by cap 7 via one-way angular transmission means 35 (FIGS. 3–6), which can be selectively deactivated once cutting member 8 reaches the lowered opening position.

More specifically, transmission means 35 comprise a number of—in the example shown, four—first teeth 36 having a sawtooth profile, projecting from end wall 19 of cap 7, and equally spaced angularly about axis A in the sealed and closed positions of cap 7; and a number of—in the example shown, eight—second teeth 37 also having a sawtooth profile, projecting radially from an inner surface 38 of cutting member 8, and which mesh with teeth 36 in axially-free, angularly-integral manner when disengaging cap 7 from collar 10 when unsealing package 1. More specifically, the disengagement of cap 7 is indicated in FIG. 1 by the anticlockwise rotation direction R of cap 7 about axis A.

More specifically, each tooth 36 comprises a connecting portion 39 projecting perpendicularly from end wall 19 of cap 7; and a meshing portion 40 projecting from connecting portion 39 towards lateral wall 10, and having a cross section in the form of an obtuse triangle. More specifically, meshing portion 40 is defined by two oblique, outwardly-converging sides 41, 42; the side (41) sloping more steeply with respect to connecting portion 39 defines a seat for a respective tooth 37 in the rotation direction R of cap 7; and the other side (42) permits angular slide of teeth 37 in the opposite rotation direction.

Each tooth 37 extends the full axial height of cutting member 8, and also has a cross section in the form of an obtuse triangle identical to that of meshing portions 40 of teeth 36 and defined by two oblique, converging sides 43, 44; and the side (43) sloping more steeply with respect to surface 38 of cutting member 8 faces side 41 of a respective tooth 36.

Cutting means 31 comprise a saw-tooth cutter 45; and a number of—in the example shown, four—substantially isosceles-triangle-shaped teeth 46 equally spaced along an arc of end edge 30 starting from cutter 45. More specifically, cutter 45 is located downstream with respect to teeth 46 in the rotation direction of cutting member 8 when cap 7 is unscrewed from frame 5.

As cutting member 8 is moved with respect to frame 5, cutter 45 and teeth 46 act along a major portion—in the example shown, roughly three-quarters—of the periphery of pierceable portion 4 to detach pierceable portion 4 partly, i.e. with the exception of a given portion, from wall 3.

Cutter 45 projects axially with respect to end edge 30 and is defined by a cutting edge 47 crosswise to pierceable portion 4 of wall 3, and by a lateral cutting edge 48 sloping with respect to axis A and connecting a free end of cutting edge 47 to end edge 30.

An important characteristic of the present invention is that cutting member 8 comprises, along lateral wall 29, a number of through openings 50—in the example shown, two pairs of quadrangular openings on diametrically opposite sides of lateral wall 29—for allowing air into package 1, when package 1 is tilted into pour positions and even when the liquid product in the package completely wets end edge 17 of collar 10, so that the pressure inside package 1 is balanced with the pressure outside and the product is poured out smoothly with no gulping.

More specifically, openings 50 in each pair are offset axially with respect to each other.

Figure 3:
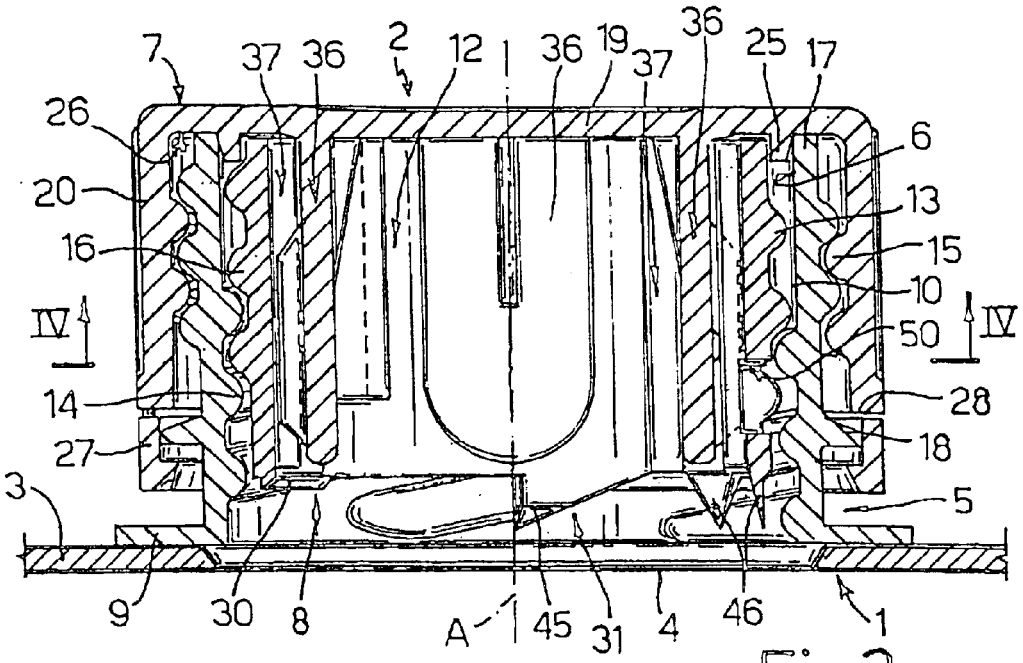
FIG. 3 shows a larger-scale axial section of the FIG. 1 opening device fitted to the package in a sealed configuration.

In actual use, as of the FIG. 3 sealed configuration, package 1 is unsealed by turning cap 7, with respect to axis A, in direction R to unscrew the cap off collar 10.

As cap 7 is turned about axis A in direction R, mating threads 13 and 15 simultaneously move cap 7 axially away from wall 3 so as to break the radial points connecting the cap to tamperproof ring 27, which is retained resting axially against rib 18 of collar 10.

During the initial movement of cap 7, teeth 36 are positioned with sides 41 resting against sides 43 of respective teeth 37 of cutting member 8, which is thus rotated about axis A in direction R.

By virtue of mating threads 13, 15 and 14, 16 sloping in opposite directions, the axial movement of cap 7 away from wall 3 of package 1 is accompanied by a simultaneous axial movement of cutting member 8 towards wall 3. More specifically, cutting member 8 is rotated by cap 7 by teeth 36 and 37 contacting at respective sides 41, 43, which, however, are simultaneously caused to slide axially with respect to each other by the spiral movement imposed on cap 7 and cutting member 8 by respective pairs of threads 13, 15 and 14, 16.

Initial rotation of cap 7 about axis A in direction R results in equal rotation of cutting member 8 and, at the same time, in axial penetration of pierceable portion 4 by the ends of cutter 45 and teeth 46.

The packaging material of pierceable portion 4 is thus pierced at various points, with very little unsealing force being applied to cap 7.

As cap 7 is rotated further, cutter 45, located downstream with respect to teeth 46 in the rotation direction of cutting member 8, advances angularly, with cutting edge 47 through pierceable portion 4, to detach the periphery of the pierceable portion from wall 3. By virtue of cutter 45 and teeth 46 also penetrating axially as they advance angularly, the part of pierceable portion 4 gradually detached from wall 3 puckers close to cutting edge 47 and is gradually folded inwards of package 1 towards the part of pierceable portion 4 not yet detached from wall 3.

Once package 1 is penetrated axially by cutter 45 and teeth 46 to the extent that pierceable portion 4 contacts end edge 30—in the example shown, when cutter 45 and teeth 46 have advanced roughly 270° about axis A—further rotation of cutter 45 and teeth 46 about axis A simply serves to fold the part of pierceable portion 4 still attached to wall 3 outwards of cutting member 8 without cutting it.

Further unscrewing of cap 7—which by now has made roughly one turn about axis A—axially releases teeth 36 and 37 (FIG. 5) so that cutting member 8 is arrested in the lowered opening position projecting axially from frame 5 and still secured to collar 10 by mating threads 14 and 16.

Cap 7 is then unscrewed fully to unseal package 1,—which may be closed by simply fitting cap 7 back onto collar 10.

Once package 1 has been unsealed, cutting member 8 can no longer be moved from the lowered opening position,—on account of teeth 36 of cap 7 being unable to reach an axial position in which to engage teeth 37 of cutting member 8, which, in the lowered opening position, keeps the cut part of pierceable portion 4 on the outside to prevent any clogging of hole 6.

As stated, when cutting member 8 is in the lowered position and package 1 is tilted to pour out the product, openings 50 below the plane of top wall 3 of package 1 allow air into package 1 even when the liquid product inside the package wets the whole of end edge 30 of cutting member 8 and a portion of end edge 17 of collar 10 of frame 5. In which condition, the pressure inside package 1 is balanced with the pressure outside, and the product is poured out smoothly with no gulping. In other-words, by providing openings 50 along lateral wall 29 of cutting member 8, opening device 2, when pouring out the product, functions in the same way as in the absence of cutting member 8.

Moreover, as compared with known opening devices, openings 50 provide for increasing outflow of the product from package 1, and for emptying package 1 completely by preventing the product from accumulating between cutting member 8 and the top of package 1.

Clearly, changes may be made to opening device 2 as described and illustrated herein without, however, departing from the scope of the accompanying claims.

What is claimed is:

1. A closable opening device or a sealed package containing a pourable product, said device comprising:

a frame defining a through hole and having means for securing the frame about a pierceable portion of said package;

a removable threaded cap which screws onto said frame to close said hole; and a tubular cutting member movably engaging said hole, rotatably connected to said cap at least when disengaging the cap from said frame and projecting axially from said frame and inwards of said package to detach said pierceable portion partly from the rest of said package; and means for locking the cutting member in a position projecting axially from the frame; and said cutting member includes along a lateral wall, at least one pair of openings, the openings of each pair being axially offset from each other to allow air into the package when pouring the product.

2. A device as claimed in claim 1, wherein said cutting member comprises an end edge having, on the face, a saw-tooth cutter acting along a major portion of the periphery of said pierceable portion to detach the pierceable portion partly from adjacent portions of said package and to fold the pierceable portion inwards of said package and outwards of the cutting member.

3. A device as claimed in claim 2, wherein said cutting member comprises a number of triangular teeth equally spaced along an arc of said end edge and acting simultaneously with said cutting member to pierce said pierceable portion at a number of points.

4. A device as claimed in claim 3, wherein said teeth are located upstream from said cutting member in the direction of said cutting member when the cap is unscrewed from the frame.

5. A device as claimed in any one of claims 2, wherein said cutter comprises a cutting edge crosswise to said pierceable portion; and a lateral cutting edge angularly defining the cutter and extending transversely from a free end of said cutting edge.

6. A device as claimed in claim 1, wherein said collar comprises, on a lateral surface opposite the lateral surface having said first thread, a third thread oppositely inclined with respect to the first thread and engaging a fourth thread formed on said cap.

7. A device as claimed in claim 6 including a tamperproof ring, the ring being molded integrally with the cap, and the tamperproof ring being positioned between the cap and the radial flange.

8. An opening device for packages for pourable product, comprising:

(a) a first tubular member having external screw threads and having a radial flange;

(b) a cap having internal screw threads arranged to cooperate with the external screw threads of the first tubular member to open and close access to the interior of the first tubular member;

(c) a second tubular member having external screw threads and having cutter elements projecting axially from the periphery of the second tubular member; the second tubular member being joined to the first tubular member and being in axial alignment with the first tubular member;

(d) at least one pair of openings in the second tubular member adjacent to the cutter elements; the openings being offset axially from each other whereby the openings allow air into the package and avoid the accumulation of the contents between the surface of a package and the second tubular member.

9. The opening device according to claim 8, wherein the second tubular member is received in telescoping relation within the first tubular member; the external screw threads on the second tubular member being arranged to move the second tubular member axially from the first tubular member upon rotation of the cap relative to the first tubular member.

10. An opening device for sealed packages of pourable products, comprising:

(a) a first tubular member having external screw threads and having a radial flange;

(b) a cap having internal screw threads adapted to cooperate with the external screw threads of the first tubular member to open and close access to the interior of the first tubular member;

(c) a second tubular member having external screw threads and having cutter elements projecting axially from the periphery of the second tubular member; the second tubular member being joined to the first tubular member and being in axial alignment with the first tubular member;

(d) at least one pair of openings in the second tubular member adjacent to the cutter elements; the openings being offset axially from each other whereby the openings allow air into the package and avoid the accumulation of the contents between the package surface and the second tubular member; and (e) the openings of at least one pair being spaced from each other on opposite sides of the second tubular member; the openings being aligned with the external screw threads on the second tubular member.

11. The opening device for sealed packages of pourable products according to claim 10 wherein the external screw threads of the first tubular member engage the internal screw threads of the cap; and wherein the internal screw threads of the cap engage the external screw threads of the first tubular member, the respective screw threads being arranged to displace the second tubular member axially relative to the first tubular member upon rotation of the cap in one direction and includes locking means for maintaining the second tubular member in a displaced position.

12. The opening device for sealed packages of pourable products, according to claim 10, including tamper evident means between said cap and said flange.

* * * * *